US006304224B1

(12) United States Patent
Lee

(10) Patent No.: US 6,304,224 B1
(45) Date of Patent: Oct. 16, 2001

(54) ADAPTER FOR ANTENNA ON A MOBILE PHONE

(76) Inventor: Chih-Hung Lee, 4 F., No. 42, Lane 75, Youg-Ping St., Shin Lin, Taipei (TW)

( * ) Notice: Subject to any disclaimer, the term of this patent is extended or adjusted under 35 U.S.C. 154(b) by 0 days.

(21) Appl. No.: 09/610,369

(22) Filed: Jul. 5, 2000

(51) Int. Cl.[7] ..... H01Q 1/24
(52) U.S. Cl. ..... 343/702; 343/841
(58) Field of Search ..... 343/702, 841, 343/900; 455/90

(56) References Cited

U.S. PATENT DOCUMENTS 5,338,896 * 8/1994 Danforth ..... 174/35 R
6,097,340 * 8/2000 Chang ..... 343/702

* cited by examiner

*Primary Examiner*—Don Wong
*Assistant Examiner*—James Clinger
(74) *Attorney, Agent, or Firm*—Dougherty & Troxell

(57) ABSTRACT

An adapter for antenna on a mobile phone basically is a main body associated with an adapting tube and a cover. A receiving recession is provided between the main body and the cover for containing a wave eliminating plate. The adapting tube is used for fitting with the antenna. The main body has a plurality of through holes for being passed by the rubber forming the adapting tube. The rubber overflowed from each through hole is associated with each other and constitutes a fixing part such that the adapting tube is integrated with the main body. The adapting tube is made of highly elastic and non-brittle rubber and has features such as flexible, free from aging, and durable. Therefore, the adapter is possible to sleeve with any size of antenna on a mobile phone firmly without a phenomenon of being loosened due to elastic fatigue and being damaged due to brittleness after using a period of time.

5 Claims, 4 Drawing Sheets

ADAPTER FOR ANTENNA ON A MOBILE PHONE

BACKGROUND OF THE INVENTION

1. Field of the Invention

The present invention relates to an adapter for antenna on a mobile phone, and particularly to an adapter with an adapting tube made of highly elastic rubber without brittleness for easily engaging with an antenna on a mobile phone firmly.

2. Description of Related Art

Due to the extremely progressive telecommunication technology, the number of mobile phones utilized is increasing continuously. Although a mobile phone offers a handier telecommunication way, it involves a potential danger that the human body being interfered by electromagnetic waves generated from the mobile phone for a long period of time is possible to result in being harmful to health. To overcome the deficiency, there is a wave eliminator available in the market to associate with the mobile phone. Because the antenna is a spot emitting the most intensified electromagnetic wave, a type of wave eliminator is fitted with the antenna to prevent the electromagnetic wave from hurting the human body. It is known that there are different styles of mobile phones with different sizes of antennas respectively but the above said wave eliminator is merely provided with a single size. In order to allow the wave eliminator being able to fit with antennas in different sizes, a number of heat contracted fitting tubes with different sizes are available for matching with different sizes of antennas. Therefore, a proper size of heat contracted fitting tube has to be selected for fitting with a specific antenna first, and then the wave eliminator is sleeved with the heat contracted fitting tube. It can be understood that it is a tedious job in order to mount the wave eliminator to an antenna on a mobile phone. In addition, the above said engaging way may cause a phenomenon of loosening after using a period of time.

SUMMARY OF THE INVENTION

An object of the present invention is to provide a adapter tube for antenna on a mobile phone, which is elastic without brittleness so as to be fitted with any size of antenna easily and firmly for a long period of time.

Other objects and features of the present invention will be apparent by way of following description of embodiments with accompanying drawings.

DETAILED DESCRIPTION OF THE PREFERRED EMBODIMENTS

Figure 1:
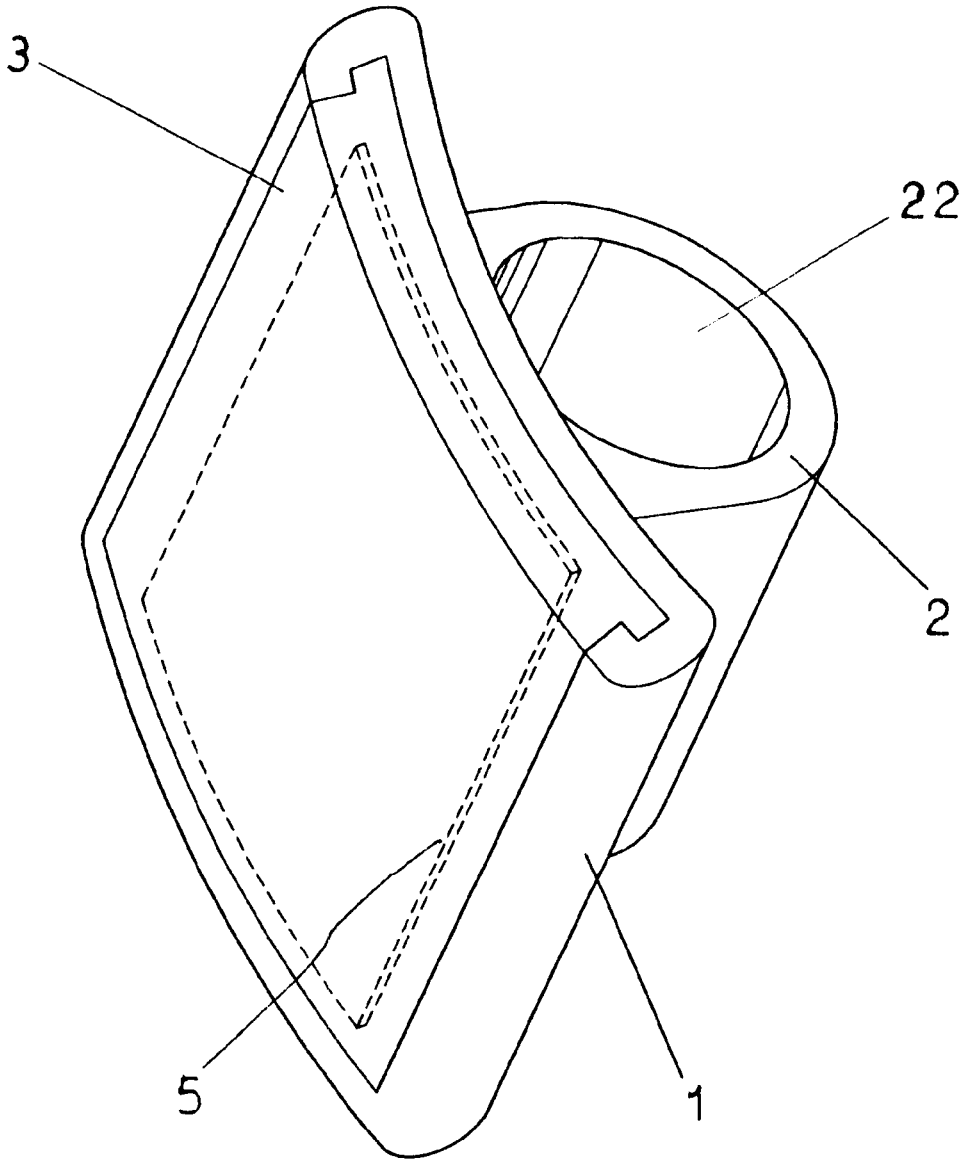
FIG. 1 is a perspective view of the present invention in a first embodiment thereof.
Figure 2:
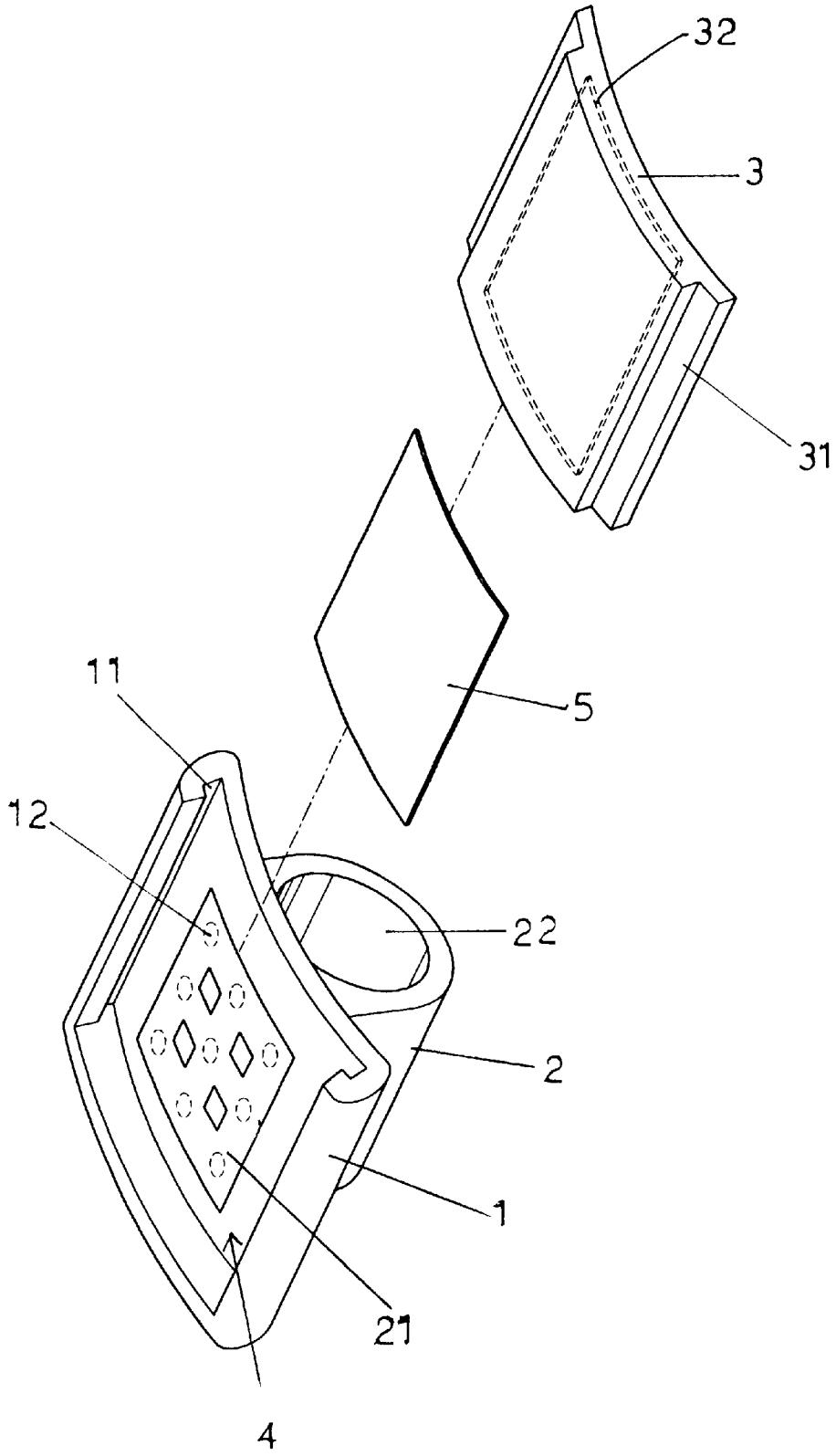
FIG. 2 is an exploded perspective view of the adapter shown in FIG. 1.

Referring to FIGS. 1 and 2, the adapter for antenna on a mobile phone according to the present invention in a first embodiment thereof comprises a main body 1, an adapting tube 2 integral with the main body 1, and a cover 3. A receiving recession 4 is provided on the main body 1 for locating the cover 3 and a wave removing plate 5. The wave removing plate 5 is mounted to the cover 3 at a groove 32 thereof. The receiving recession 4 at both lateral sides thereof provides an engaging groove 11 respectively such that a respective projecting edge 31 at both lateral sides of the cover 3 is able to slide into the engaging groove 11 for engagement. The main body 1 has a plurality of holes 12 to allow the molten material overflowing to the other side thereof while the adapting tube 2 is integrated with the main body 1 such that the overflowed material forms a fixing part 21. Hence, the adapting tube 2 is associated with the main body 1 by way of the adapting tube 2 and the fixing part 21 being held at both sides of the main body 1. The adapting tube 2 has a flexibly sized hole 22 to sleeve with any size of antenna on a mobile phone. Besides, the wave removing plate 5 can be made to have a shape as the cover 3 does and fits with the main body 1 directly such that it is not necessary to provide the cover 3.

Figure 3:
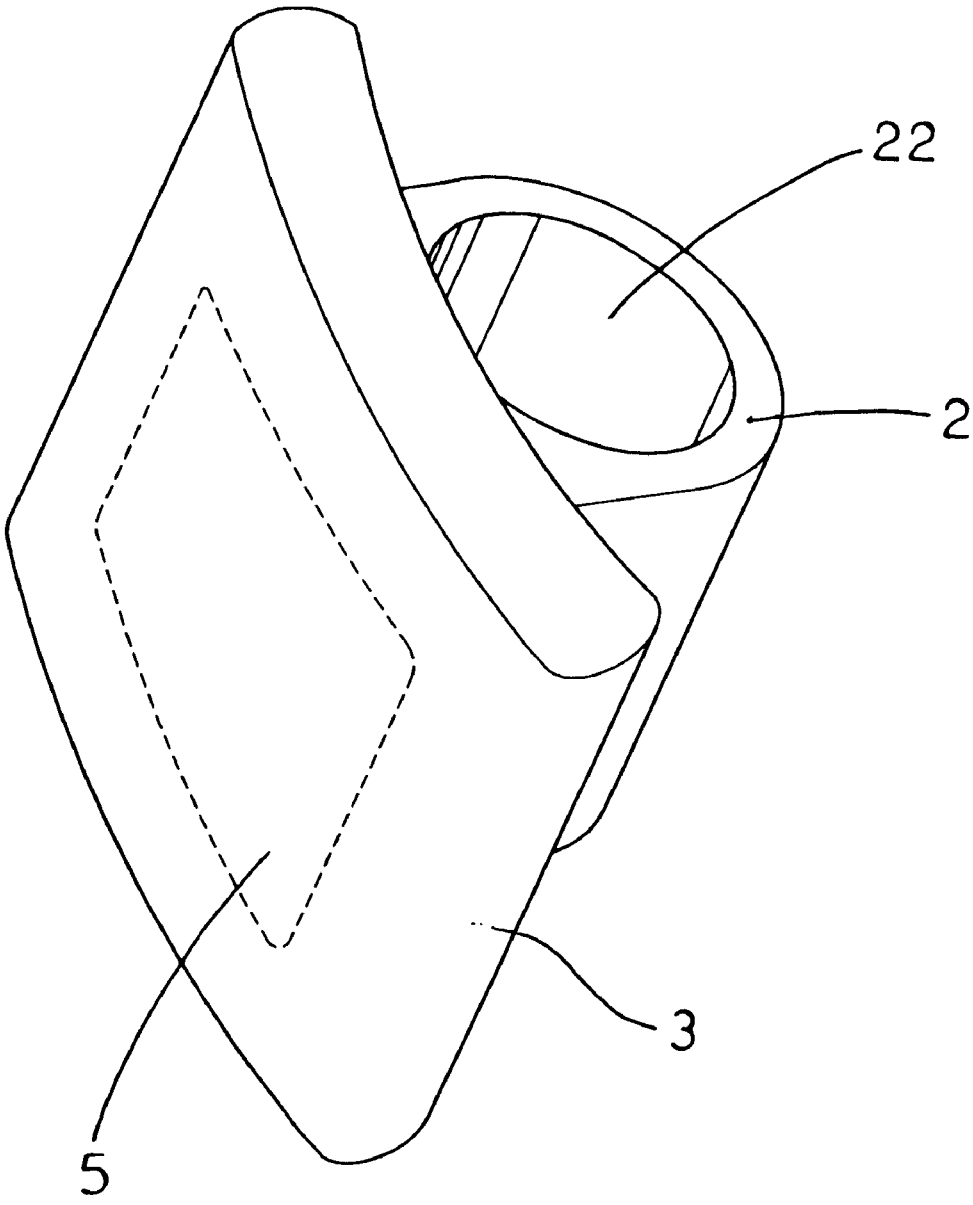
FIG. 3 is a perspective view of the adapter in a second embodiment of the present invention.
Figure 4:
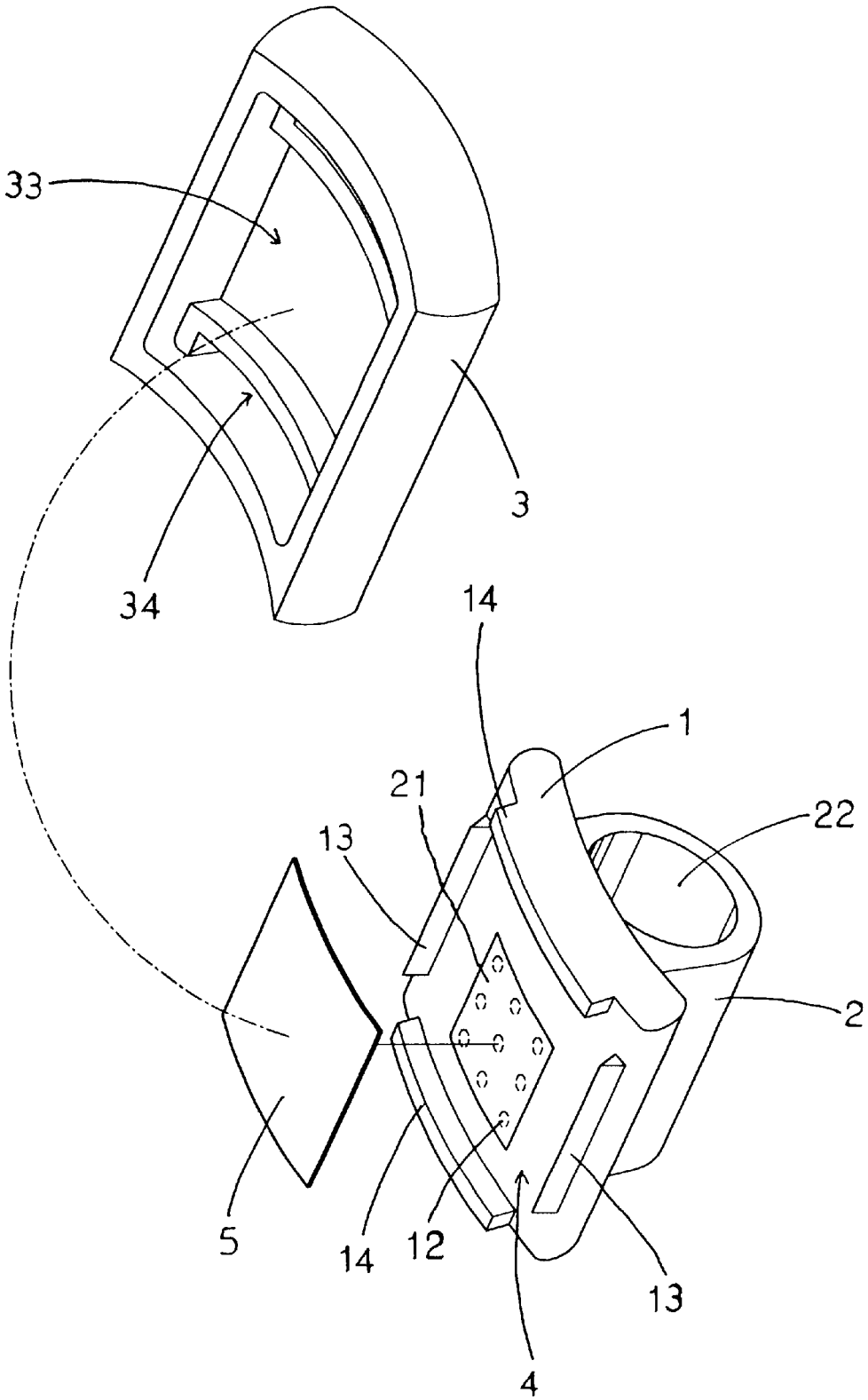
FIG. 4 is an exploded perspective view of the adapter shown in FIG. 3.

Referring to FIGS. 3 and 4, the second embodiment is illustrated. Basically, the main body 1 associated with the adapting tube 2 in the second embodiment has the same arrangement as the first embodiment does. However, the main body 1 associated with the cover 3 in the second embodiment is different from the first embodiment does. There are two opposite ribs 13 and two opposite insert plates 14 around the receiving recession 4 of the main body 1 in the second embodiment. The ribs 13 function as reinforcement. The cover 3 has an inward room 33 for receiving the main body 1 and two opposite insert grooves 34 are provided at the inward room 33 to correspond to the insert plates 14 such that the cover 3 and the main body 1 may engage with each other. A wave removing plate 5 is placed in the receiving recession 4.

The main body 1 illustrated in the present invention is made of hard material such as fiber reinforced plastic but the adapting tube 2 is made of flexible material. Conventionally, the adapting tube 2 is attached to the main body 1 by way of adhesive and it is easily detached. To overcome the shortcoming, part of the material on the adapting tube 2 covers the main body 1 such that the flexible tube 2 can engage with the main body 1.

Another feature of the present invention resides in that the adapting tube 2 is highly elastic and without brittleness so that the flexible sized hole 22 may easily sleeve with any sized antenna on a mobile phone. In addition, because the adapting tube is not possible to become brittle and aging, the adapter of the present invention is durable for a long period of time without loosening or rupture.

While the invention has been described with reference to preferred embodiments thereof, it is to be understood that modifications or variations may be easily made without departing from the spirit of this invention, which is defined by the appended claims.

What is claimed is:

1. An adapter for an antenna of a mobile phone comprising:

a) a main body having a receiving recess;

b) a cover having a wave removing plate mounted therein, the cover mounted on the main body so as to cover the receiving recess; and, c) an adapting tube of elastic rubber attached to the main body and extending therefrom, the adapting tube having a hole therethrough for accepting the antenna therein, the hole being capable of accepting various sizes of antennas due to the elasticity of the adapting tube.

2. The adapter of claim 1 further comprising:

a) engaging grooves formed in opposite lateral sides of the main body; and, b) projecting edges on opposite lateral sides of the cover located so as to slidably engage the engaging grooves to thereby mount the cover on the main body.

3. The adapter of claim 2 further comprising a groove formed in the cover in which is inserted the wave removing plate.

4. The adapter of claim 1 further comprising:

a) a pair of insert plates extending from the main body; and, b) a pair of insert grooves formed in the cover receiving the insert plates therein.

5. The adapter of claim 4 further comprising a recessed chamber in the cover in which is located the wave removing plate.

* * * * *